US005890613A

United States Patent [19]

Williams

[11] Patent Number: 5,890,613

[45] Date of Patent: Apr. 6, 1999

[54] MODULAR COOLER CONSTRUCTION

[76] Inventor: Warren Bret Williams, 1535 Ramona Ave., Salt Lake City, Utah 84105

[21] Appl. No.: 897,591

[22] Filed: Jul. 21, 1997

[51] Int. Cl.[6] ..... B65D 21/00

[52] U.S. Cl. ..... 220/23.4

[58] Field of Search ..... 220/23.4, 23.6, 220/23.83, 23.86

[56] References Cited

U.S. PATENT DOCUMENTS

| | | | |
|---|---|---|---|
| 3,194,426 | 7/1965 | Brown, Jr. | 220/23.4 |
| 3,642,337 | 2/1972 | Manheim | 220/23.4 X |
| 4,192,562 | 3/1980 | Bishoff et al. | 220/23.4 X |
| 4,893,719 | 1/1990 | Lombardi et al. | 220/23.4 |
| 5,263,576 | 11/1993 | Boreen et al. | 220/23.4 X |
| 5,299,688 | 4/1994 | McKay et al. | 220/23.4 X |
| 5,310,071 | 5/1994 | Rivlin et al. | 220/23.4 |

*Primary Examiner*—Steven M. Pollard
*Attorney, Agent, or Firm*—M Ralph Shaffer PC.

[57] ABSTRACT

A modular cooler construction comprised of a series of various-sized containers interlocked together to provide versatility for various capacities of food storage as may be desired; axillary drawer structures are likewise supplied and interlocked with the primary containers to provide for meat and dry ice storage and the like.

5 Claims, 4 Drawing Sheets

MODULAR COOLER CONSTRUCTION

FIELD OF INVENTION

The present invention pertains to coolers useful for camping, boating, fishing and the like and, more particularly, to a new and improved modular cooler construction containing a series of suitably sized containers with lids that can be interlocked together to provide for a wide versatility of use and desired function. Storage drawer structure can also be provided.

BRIEF DESCRIPTION OF PRIOR ART

There are numerous types of coolers that have been developed and are now on the market. Standard coolers comprising containers having hinged lids and carrying handles have been employed for scores of years. Containers extant may include rigid containers or containers having inner and outer skins provided with an expanded core, for insulative purposes. No art is known to the inventor where a series of multi-sized containers can be interlocked together to provide for versatility and storage and, especially, for including base drawer components, releasably interlocked to the container structure, whatever this may be, so as to provide for meat and dry ice storage and the like.

It would be highly desirable of course to provide suitable and versatile modular cooler structure wherein various components can be selectively connected together for providing a wide range of possible food and beverage storage, coolant supply, and the like.

BRIEF DESCRIPTION OF THE INVENTION

Accordingly, the present invention provides a modular cooler construction comprising a series of mutually interlocked containers. The interlocking feature may be comprised of slide rails and cooperating undercut groves, or by other means. Detents can be provided for selectively positioning the containers and releasably interlocking these in desired configurement.

Another feature of the invention includes the provision of one or more drawer structures suitable for containing meats, dry ice and the like, which drawer structures can be secured to the respective bases of the containers employed. The containers themselves are of differing widths so that a selected number and size of containers can be employed with a selected number of drawer structures. Once assembled in modular form, the unit can be carried as a unit to its desired camping location, fishing boat, and so forth. For smaller groups certain ones of the containers can remain in storage while the remaining be assembled in convenient fashion for unitary modular conditions such that the same, with their drawers, if desired, can be moved about as a unit to a desired location.

OBJECTS

According, a principle object of the present invention is to provide a new and useful modular cooler construction.

A further object is to provide a cooler construction providing interlocking components, both for primary container storage and also for coolant and/or meat storage, with the entire construction being releasably interlocked together, as desired.

An additional object is to provide a new and improved modular cooler construction wherein the sizes of containers are preselected such that they may be interlocked in various manners and be suitable for accommodating one or more cooler drawer structures.

IN THE DRAWINGS

The present invention, both as to organization and manner of operation, may best be understood by reference to the following detailed description, taken in conjunction with the accompanying drawings, in which.

FIGS. 5A–5D are enlarged front elevations of modular cooler constructions wherein there are central and side containers provided with a pair of drawer structures, (FIG. 5A), a pair of end containers interlocked together and provided with a single drawer construction, (FIG. 5B), a central container having a single drawer construction, (FIG. 5C), and a pair of large (central, see FIG. 1) containers incorporating a pair of drawer constructions at their bases.

DETAILED DESCRIPTION OF PREFERRED EMBODIMENTS

Figure 1:
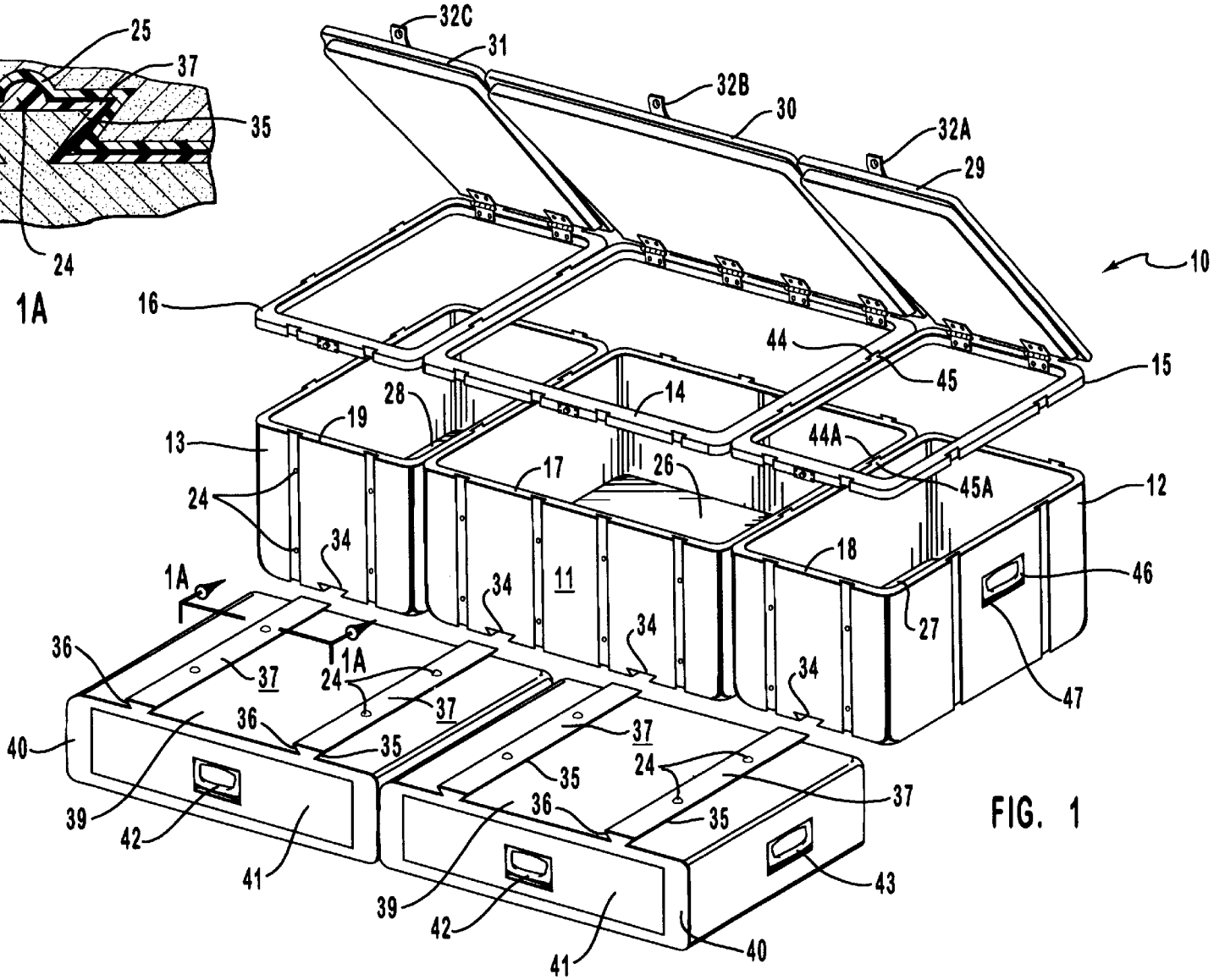
FIG. 1 is an exploded perspective view of the modular container construction of the present invention, in one form thereof.
Figure 1A:
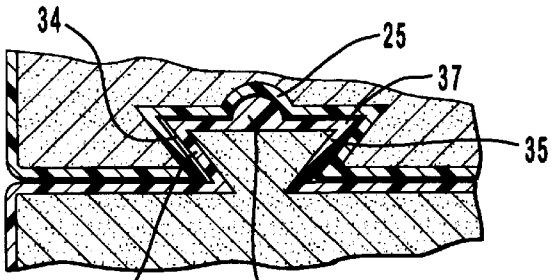
FIG. 1A is an enlarged cross-section detail taken along the line 1A—1A in FIG. 1; the inclusion of the detent protuberance and receiver, e. g. as shown herein, can be typical of all slide rail/undercut slot or similar constructions as utilized herein.

In FIG. 1 a modular cooler structure 10 is shown to include a central container member 11, side container member 12 and opposite-side container member 13. The container members 11–13 have respective container lip frames 14, 15, and 16 as shown. Each of the container members 11–13 includes a respective peripheral sidewall 17–19, respectively, and each sidewall can be made up of an expanded core material 20, e. g., such as Polystyrene, that is backed by respective skin layers 21 and 22 that can be fabricated from a rigid plastic material by way of example, see FIG. 4. Adjacent skin layers 22, 23 by way of example, of adjacent container sidewalls can be provided with respective detent-receiving depressions receivers 25, which mutually co-act together with respective detent protuberances 24 to effect the relative mutual positioning of adjacent containers.

Figure 4:
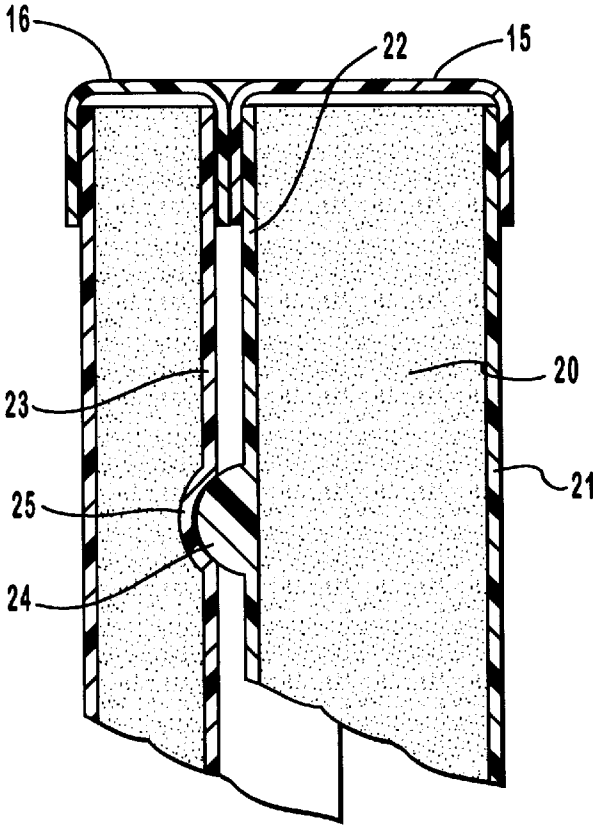
FIG. 4 is an enlarged fragmentary detail, taken in cross-section along the line 4—4 in FIG. 3, illustrating the sidewall construction of the containers at the recess provided go for the interlock function as hereinafter described.

The several container lip frames 14–16 preferably have elemental transverse cross-sections which are channel shaped, see FIG. 4, so that these may receive the upstanding top edges of respective, side adjacent containers.

Each of the container frames 14–16 is designed to be secured over the respective upper sidewall edges of the container members, see FIG. 4 by way of example, by means of a suitable adhesive, e. g. epoxy or glue. Referring back to FIG. 1, it is seen that each of the containers include respective bottoms or undersides 26–28 to and about which the respective peripheral sidewalls 17–19 will be secured.

Hinged to each of the respective frames 14–16 will be top covers 29, 30 and 31 as indicated. Each of the top covers may include a respective opener tab 32A, 32B and 32C.

Molded into each container at their bottoms are slide rail receiving slots 34. These are undercut in a manner as to receive in slidable fashion the tapered sides 35, 36 of cooperatively configured, respective slide rails 37. Such slide rails can be fabricated as independent parts, and attachments can be used to secure the slide rails to the respective tops 39 of drawer receptacles 40. The drawer receptacles 40 slidably receive drawers 41, and each of these can be provided with a drawer-pull such as a conventional hinged drawer clasp 42 as shown. If desired, the sides of the containers or receivers may likewise be supplied with latches or grasp-rings 43, see FIG. 3, in any manner desired.

The lip frames and also the several containers may be releasably secured together by the provision of undercut slots 44 matching the corresponding tabs 45, which can be molded not only in the container lip frame constructions but also in the container sides as seen, by way of example, at 44A and 45A. At the option of the fabricator, these tab-slot configurements can be employed for releasably securing all the container members together, and be provided for all or selected sides of the respective container members, as may be desired.

Likewise, selected ones of the containers may include customary pivoted handclasps 46, disposed in recesses 47, customarily supplied standard cooler constructions.

Figure 2:
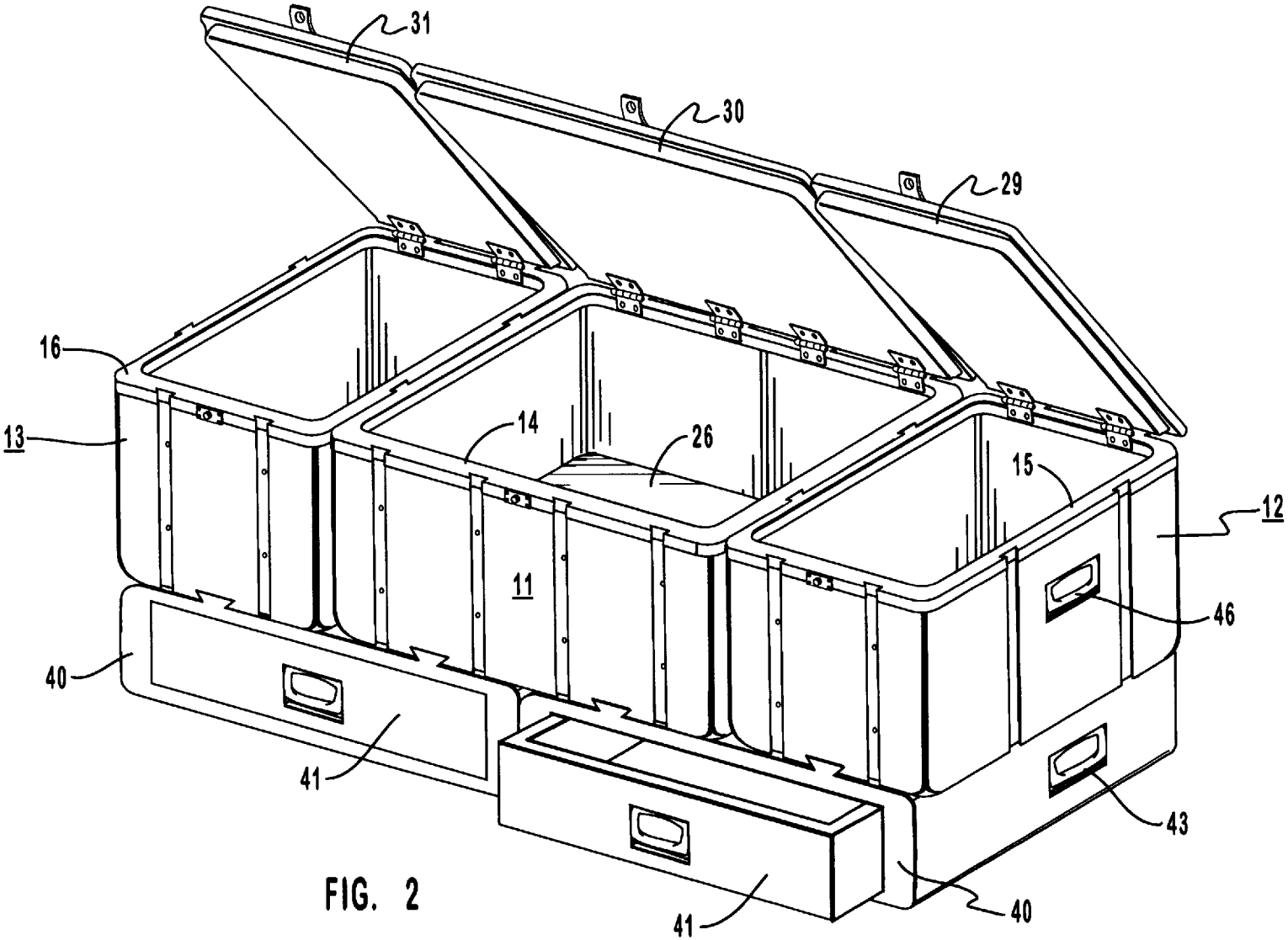
FIG. 2 is a perspective view of the structure of FIG. 1 when assembled.

FIG. 2 illustrates the modular cooler construction of FIG. 1 as being assembled together, with the frames being secured in place, as by an adhesive, to and over the upstanding lips of the respective container members. A respective drawer 41 is partially withdrawn as shown so that there may be indicated a convenient insert area for meats, fish, dry ice and so forth. It has been found desirable to separate dry ice from other types of foods such as fruits and vegetables; hence, the drawers 41 are provided. Thus, when it is desired, dry ice or simply other types of coolant such as ice cubes may be deposited within the respective containers, and these may be filled with all types of food items, both prepared items, vegetables and so forth.

Figure 3:
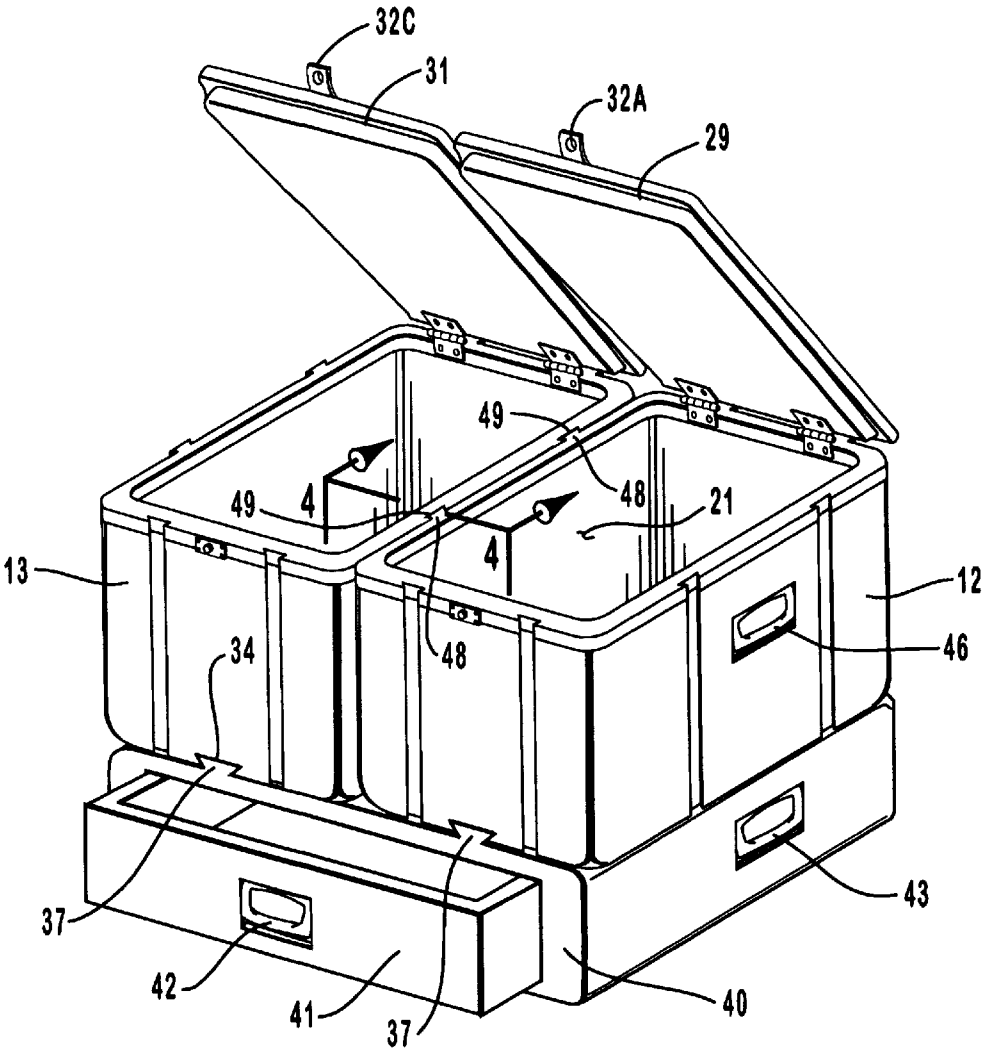
FIG. 3 represents an alternate form of the invention wherein the opposite side containers of FIGS. 1 and 2 are o joined together, the central container not being used in this construction, whereby the side containers can accommodate a single lower drawer construction releasably secured thereto.

There may be times when individuals may not need the three containers as shown in FIGS. 1 and 2, in which event the central container 11 can simply to stored at home with its lid and the two side containers be employed and simply joined together by the respective vertical slide rails and slots as at 48 and 49 in FIG. 3. In such case, then a single drawer 41 and drawer receiver or container 40 need be employed, and this can be mounted to the two side-by-side containers 12, 13 in the manner indicated in FIG. 3 wherein respective undercut rails 37 are frictionally slid into the respective undercut receiving slots 34 thereat.

The section line 4—4 in FIG. 3, now directing the readers attention to FIG. 4, indicates that while the thickness of the walls of the containers can be the same, the slotted area receiving the slide rail as at 48 displays a difference in thickness of the composite container walls at the slotted locations only.

Figure 5B:
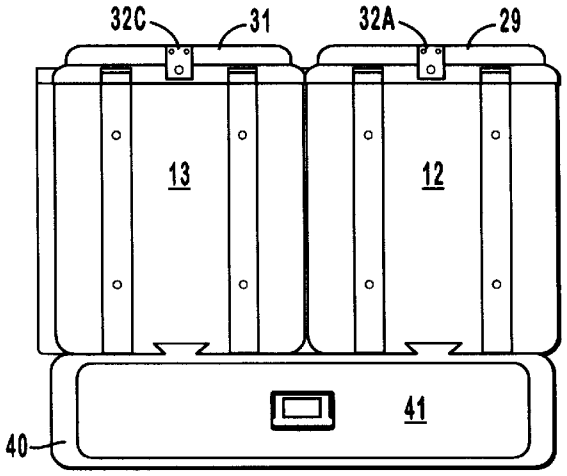
Figure 5A:
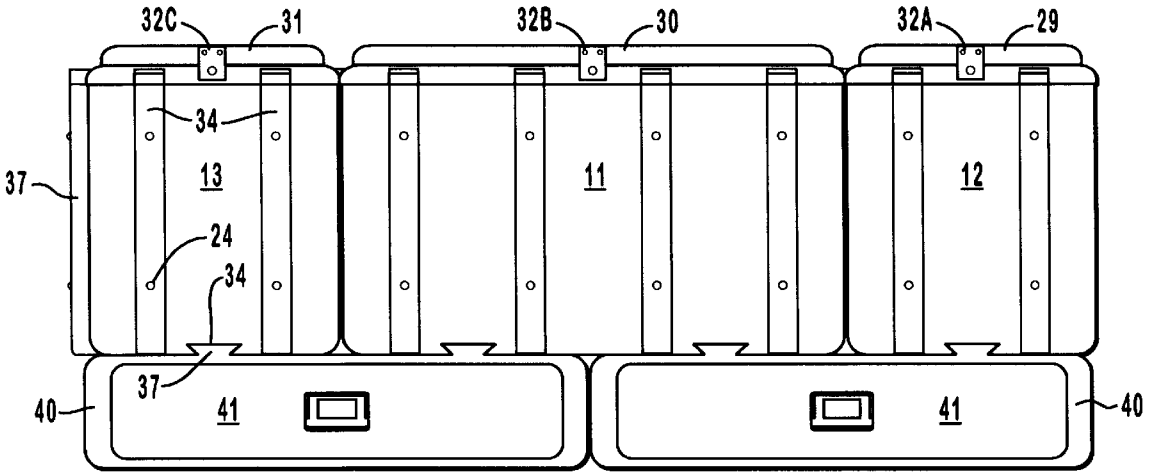

FIG. 5A is an enlarged front elevation of the structure of FIGS. 1 and 2, illustrating a three-chest container configurement, with plural drawers being provided at the base and suitably joined to the container member as by the slide rails before mentioned.

FIG. 5B is an enlarged front elevation of the structure of FIG. 3, illustrating a single drawer that accommodates the two side containers which are joined together and all so to the drawer receptacle construction.

Figure 5D:
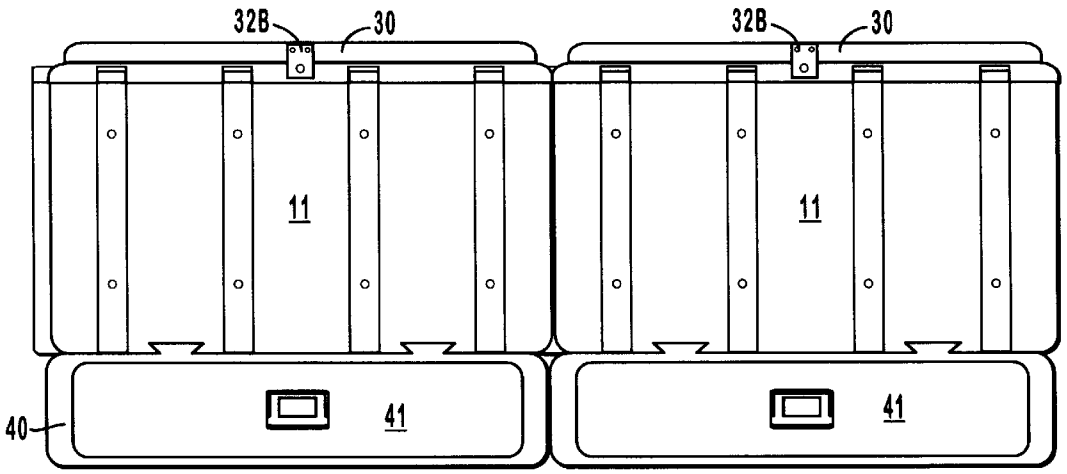
Figure 5C:
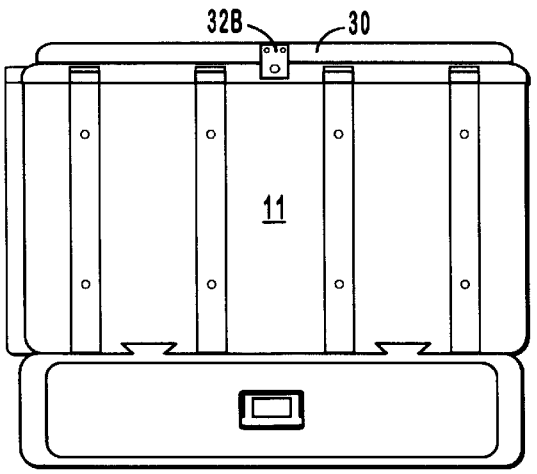

Likewise, a single chest such as the central storage container member at 11 can be provided with a single drawer and drawer receptacle as at 41, 40 in FIG. 5C; FIG. 5D illustrates the case where there is more than one central container member, the structure being provided with a pair of respective drawers 40 and 41.

In a preferred construction the opposite-end container members in FIGS. 1 and 5A are of the same width and one-half the width of the central container member. The drawer receptacles are each the same width as the central container member. In such event, then, there is accommodated the three containers as seen in FIGS. 1 and 2, with a single drawer accommodating a pair of side-by-side disposed side container members as at 12 and 13, see FIG. 3. Alternately, the central container alone may accommodate single drawer structure, or, if a pair of large central containers are available, then the two may be employed together and provided with a pair of the drawer container structures, see FIG. 5D.

Appropriate sizing as indicated makes it possible to provide a wide range of assorted cooler constructions for providing various capacities for food storage.

While particular embodiments of the present invention have been shown and described it will be obvious to those skilled in the art that various changes and modifications may be made without departing from the essential features of this invention and therefore, the aim of the appended claims is to cover such changes and modifications as fall within the true spirit and scope of the invention.

I claim:

1. Modular cooler structure including, in combination, plural rectangular container members of rectangular transverse cross-section each having a hinged lid and an underside, said container members each having vertically oriented, mutually intercooperable means for releasably securing said members together in flush side-engaging side-by-side relationship, and wherein said mutually intercooperable means include respective detent-protuberance means and detent-depression receiver means for determining the releasable mutually vertical positioning of said containers, and further wherein, when said container members are joined together, said structure also includes a base-disposed receiver member providing an interior, self-contained drawer and having plural means for releasably securing said receiver member to said undersides of said container members.

2. The structure of claim 1 wherein said receiver member and at least one of said container member undersides include respective detent protuberance means and intercooperable detent-depression receiver means for determining the releasably mutual positioning of said receiver member and one of said container members.

3. In combination, a molded container having a bottom and an upstanding sidewall projecting upwardly from the periphery of said bottom and having an upper edge, and a molded container lip frame secured to and over said upper edge and having a container lid hinged to said frame, said container and said frame having aligned vertical undercut, slide-rail-receiving slots.

4. A modular container structure including, in combination, a central container member, a pair of side-opposite container members disposed respectively at opposite sides of said central container and each side-opposite container having a width essentially equivalent to one-half the width of said central container member, said side-opposite container members having respective exterior sidewall means for releasably securing said side-opposite container members to opposite sides of said central container member, a pair of side-by-side disposed drawer receivers releasably secured to and underneath said side-opposite container members and overlapping said central container member, and drawers respectively slidably disposed within said receivers.

5. In combination, a pair of containers releasably secured together and having respective undersides, and a drawer receiver having a pull-out drawer, said drawer receiver overlapping both of said containers at their undersides, said containers and drawer receiver having respective slide-rail and undercut grooved means, mutually intercooperating, for releasably securing said drawer receiver to and underneath both of said containers.

* * * * *